US007645203B2

(12) United States Patent
Tang et al.

(10) Patent No.: US 7,645,203 B2
(45) Date of Patent: Jan. 12, 2010

(54) GAME BALL CARCASS, A GAME BALL, AND METHODS OF MAKING SAME

(75) Inventors: Ya Fang Tang, Kowloon (HK); Margaret Yuen Yuen Chang, Ontario (CA)

(73) Assignee: Frank I Teh Chang, Hong Kong (HK)

( * ) Notice: Subject to any disclaimer, the term of this patent is extended or adjusted under 35 U.S.C. 154(b) by 0 days.

(21) Appl. No.: 11/049,667

(22) Filed: Feb. 4, 2005

(65) Prior Publication Data

US 2005/0277499 A1 Dec. 15, 2005

(30) Foreign Application Priority Data

Jun. 9, 2004 (CN) ..... 2004 1 0048922

(51) Int. Cl.
*A63B 41/08* (2006.01)

(52) U.S. Cl. ..... 473/604; 473/610

(58) Field of Classification Search ..... 473/603–605, 473/607–611, 599
See application file for complete search history.

(56) References Cited

U.S. PATENT DOCUMENTS

| | | | | | |
|---|---|---|---|---|---|
| 1,800,178 | A | * | 4/1931 | Cooper et. al. | 473/610 |
| 1,870,604 | A | * | 8/1932 | Coles | 473/603 |
| 1,994,790 | A | * | 3/1935 | Roedding | 473/610 |
| 2,116,479 | A | * | 5/1938 | Reach | 473/604 |
| 2,317,939 | A | * | 4/1943 | Riddell | 473/604 |
| 2,579,294 | A | * | 12/1951 | Brown | 473/605 |
| 4,462,590 | A | | 7/1984 | Mitchell | |
| 4,595,200 | A | * | 6/1986 | Shishido | 473/570 |
| 4,856,781 | A | | 8/1989 | Shishido et al. | |
| 4,963,117 | A | * | 10/1990 | Gualdoni | 446/219 |
| 5,035,426 | A | * | 7/1991 | Spector | 473/599 |
| 5,772,545 | A | | 6/1998 | Ou | |
| 6,039,662 | A | | 3/2000 | Chan | |
| 6,056,067 | A | | 5/2000 | Brown | |
| 6,206,794 | B1 | | 3/2001 | Chan | |

FOREIGN PATENT DOCUMENTS

WO WO 2004056424 A1 * 7/2004

* cited by examiner

*Primary Examiner*—Steven Wong
(74) *Attorney, Agent, or Firm*—Studebaker & Brackett PC; Donald R. Studebaker

(57) ABSTRACT

A carcass of a soccer ball or other inflatable game ball has a bladder with a valve for introducing air into said bladder; a fabric pocket layer located outside said bladder composed of a plurality of fabric pieces sewn to form a spherical shape, with a hole for the valve, the sewing thread for sewing said fabric pieces and the sewn margin being located in the inner side of said fabric pocket, and an opening being cut for reversing and placing the bladder being located on one of the fabric pieces; and an opening-cover adhered solidly on said opening for enclosing said opening. The surface of the manufactured ball is soft, with good tactility and the performance of ball-controlling is good. At the same time because there is no sewn margin left on the out side of the fabric pocket layer, no slight unevenness will exist on the surface of the fabric pocket layer, the ball will have a substantially perfect spherical shape, and can be easily controlled by athletes during a game.

20 Claims, 6 Drawing Sheets

GAME BALL CARCASS, A GAME BALL, AND METHODS OF MAKING SAME

BACKGROUND AND SUMMARY OF THE INVENTION

This application claims the priority of P.R. China Application No. 2004/100489226 filed Jun. 9, 2004, the disclosure of which is expressly incorporated by reference herein.

The present invention relates to a game ball carcass and a game ball utilizing said carcass, such as a football (soccer ball), as well as methods of making game ball carcass and game balls. In this application, the term "carcass" refers to an inflatable ball bladder and a reinforcing layer as a composite unit.

Conventionally, balls for ball games having a construction where air is confined, such as soccer ball, volleyball and handball, include a bladder made of rubber where air is confined, a reinforcing layer and a skin layer composed of leather. According to different manufacturing methods of the carcass and the skin layer, balls for ball games can be categorized into hand-stitched balls and laminated balls.

A hand-stitched ball for a ball game such as described in the U.S. Pat. No. 4,462,590, is composed of a bladder made of rubber and a skin layer. The bladder is made of rubber which air can not permeate, and by enclosing compressed air through a valve it forms a spherical hollow bladder body. The skin layer is obtained by sewing a plurality of leather panels in such a manner that marginal edges of the leather panels are folded inward and sewn together with threads (about 10,000-denier thread) to form a spherical body. This kind of ball for a ball game is sewn by hand. The leather panels are made of artificial leather or genuine leather. 3 to 4 pieces of fabric (liner-material) are adhered to the back of the artificial leather to enhance the strength. There is no reinforcing layer or fabric pocket layer covering the bladder in such a structure.

Said hand-stitched game balls show merits such as softness, good tactility, easiness for using and good controlling performances. But on the other side, three-dimensionality of the sphere and the thickness (about 4 to 5 mm) and hardness of said leather panels make it impossible or impractical for sewing-machine-making, only hand-stitching is possible or practical. Hence the following problems arise: because of the differences of familiarity and skills of sewing between different operators, the efficiency to produce such kind of game ball is low, the price is high, and quality problems such as differences in weight and size, and deviation from complete spherical shape occur. The defective rate is 2 to 3 times the defective rate of later described laminated ball, with unfavorable durability and inclination of deformation.

The inner pressure of a soccer ball is about 1.0 kg/m$^2$, and impaction of several hundred kg is applied to the ball when kicked. Therefore seams of the ball may come apart and the ball becomes larger than standard dimension, or becomes deformed. Further, during the impaction, threads may rupture and the bladder may protrude. Generally speaking, the durability of hand-stitched balls is below ½ to ⅓ of the durability of the later described laminated balls.

The laminated balls, such as described in U.S. Pat. No. 4,333,648, include: a similar bladder made of rubber as the bladder of said hand-stitched ball, a reinforcing layer composed of several-thousand meters of nylon filament extending in multiple directions on the bladder (the structure of filament winding is called winding-structure), a covering rubber composed of sulfureted rubber covering on the reinforcing layer, and a skin layer composed of a plurality of leather panels adhering to the covering rubber.

The bladder and the reinforcing layer as a composite unit can be called a carcass.

The quality of the ball (weight, size, sphericity, the performance of shape-keeping and durability) is improved by said reinforcing layer. Said covering rubber firmly adheres leather panels onto the carcass.

Because of said structure of said laminated ball, it can be manufactured mechanically and the efficiency of productivity is higher with less difference in weight and size, and the price is low, with good sphericity and outstanding durability. The disadvantage is its hard tactility and when the ball is touched pain will be caused. Because of its hardness it is difficult to be controlled; therefore sophisticated techniques can hardly be performed during the playing of games with the ball.

Because of the reason of hardness of the laminated ball, impaction of kicking can only be absorbed by the stretching and contracting of the nylon filament making the reinforcing layer, while the performance of absorbing impaction of nylon filament is unfavorable.

Several strategies have been proposed for resolving said problems.

A ball is described in U.S. Pat. No. 5,772,545, comprising: the same bladder as said two kinds of balls, the same reinforcing layer composed of several-thousand meters of nylon filament, and a skin layer made in such a manner that marginal edges of the leather panels are folded inward and sewn together with threads (about 500-denier) by a sewing machine. This time because of the existence of a reinforcing layer wound with nylon filament, no liner material is necessary for the leather panels, hence thin (about 1.0-1.5 mm) and soft leather panels can be sewn by a sewing machine. The composition of said bladder and nylon filament wound on said bladder (i.e. carcass) is inserted into the leather sphere of leather panels sewn by a sewing machine.

Said structure can be manufactured mechanically with outstanding sphericity and durability.

However, because of the reinforcing layer of winding-structure being the same as in a laminated ball, disadvantages such as hardness and uneasiness in controlling have not been eliminated. At the same time, because threads are thinner and lay on the surface, they can be cut when the ball collides with a grain of rock or a gravel in the playing field surface. Also sewing holes on leather panels are easily split. Further, because of visible threads between the leather panels, it is easy to give an impression that the balls have been manufactured in a rough way.

Balls for ball games of the following structure have been further proposed for resolving problems associated therewith.

A ball of the following structure is disclosed in the U.S. Pat. No. 4,856,781: 12pieces of fabric trapezoid are sewn together along their margins to form a fabric pocket layer of spherical shape as a reinforcing layer, only one side of the twelve fabric pieces is left un-sewn, and the only one side serves as a hole for placing a bladder, then the fabric pocket layer is reversed through the hole to put sewn margins into the inner side and place said bladder into the fabric pocket layer through the opening. Then the only one side of the opening is sewn from outside and leather panels are adhered onto the sewn fabric pocket layer i.e. onto the carcass. Finally compressed air is supplied through the valve (not shown on figures).

This last mentioned structure can be manufactured mechanically, the efficiency being high, the price being low, with outstanding sphericity and durability. The reinforcing layer is composed of fabric pieces, and, due to the diagonal effect of fabric, the ball shows good tactility and can be easily controlled. Diagonal effect means that when the fabric is stretched from an angle, e.g. 45°, deviated from opposite longitudinal and latitudinal threads, the fabric will show great flexibility. Therefore the performance of stretching and contracting during impaction is favorable.

However, in said improved method, the only one side of the opening is sewn from the outside of the fabric pocket. Slight unevenness on the surface of the fabric pocket caused by said outside sewn margin will appear on the surface of the ball through the leather panels, and disadvantages such as swinging on flying and anomaly in rolling and bouncing exists. Also the appearance is bad due to said unevenness and gives an impression of roughness. Further, for ball games such as volleyball, handball and the like, in which fine tactility of finger tips is important, the slight unevenness is quite a serious problem.

An object of certain preferred embodiments of the present invention is to resolve the problems due to the slight unevenness at the sewn margin of the opening of the reinforcing layer of the carcass of a game ball, such as the uneasiness of ball-controlling and the low qualities such as bad appearance and tactility.

Whereas current techniques give rise to said problems, one aspect of the present invention is to provide a carcass of a game ball, the sewn margins of the opening of which lie in the inner side of the fabric pocket, with no slight unevenness caused by said sewn margin on the surface of fabric pocket layer. The productivity is high, and qualities such as sphericity and tactility are good.

Another object of certain preferred embodiments of the present invention is to provide a game ball containing said carcass, which improves the ball-controlling of the game ball.

According to certain preferred embodiments of the present invention, a game ball carcass is provided which includes: a bladder with a valve for introducing air into said bladder; a fabric pocket layer located outside said bladder comprising a plurality of fabric pieces sewn to form a spherical shape, with a hole for the valve; the sewing thread for sewing said fabric pieces and the sewn margin are all located in the inner side of said fabric pocket, and an opening being cut for reversing and placing the bladder is located on one of the fabric pieces; and an opening-cover for enclosing said opening.

According to certain preferred embodiments of the present invention, the ball carcass opening-cover is adhered solidly on said opening.

According to certain preferred embodiments of the present invention, said hole for the valve is located at a position of the opening-cover.

According to certain preferred embodiments of the present invention, the cut opening is ring-shaped, said opening-cover is anoriginal opening part of said cut fabric piece, and said valve opening of said fabric pocket layer is located on said opening-cover. The cutting line forming said opening is an unclosed ring, and the opening-cover has a base of fabric connecting to the fabric piece.

According to certain preferred embodiments of the present invention, the cutting line forming said opening is of a multiple cross shape, hence forming several pieces of opening-cover connected to the fabric piece on the base, and said valve opening of said fabric pocket layer is located at the cross point of said cutting line. Through the reinforcing cloth adhered onto the inner side, said opening-cover encloses said opening.

According to certain preferred embodiments of the invention, said valve opening and the opening for the bladder might lie in the same fabric piece. According to certain preferred embodiments of the invention, reinforcing cloth is set at said opening for the bladder. Said opening-cover may be integrated together or separated from the opening for the bladder. Said opening-cover is adhered by adhesive onto the opening on the fabric pocket layer. Sewing lines are pre-printed onto said fabric pieces of the fabric pocket layer, and sewing will be along said lines. Said bladder is composed of rubber.

According to certain preferred embodiments of the invention, a game ball is provided which comprises in sequence from an inner to an outer side: a bladder with a valve for introducing air into said bladder; a fabric pocket layer located outside said bladder, and a skin layer comprising a plurality of panels; a plurality of fabric pieces sewn to form a spherical shape, with a hole for the valve; the sewing thread for sewing. said fabric pieces and the sewn margin are all located in the inner side of said fabric pocket, and an opening being cut for reversing and placing the bladder is located on one of the fabric pieces; and an opening-cover for enclosing said opening.

According to certain preferred embodiments of the invention, said game ball skin layer is a skin layer of an adhesion structure formed by skin pieces adhered onto the fabric pocket layer directly or through the covering rubber, and said skin layer is sewn by a sewing machine. A counter weight of similar weight as the weight of the valve and valve house are placed opposite to the valve in the fabric pocket layer or the bladder. Said ballast can be made of rubber or fabric. Sewing lines are pre-printed on the fabric pieces of the fabric pocket layer.

According to certain preferred embodiments of the invention, in the carcass of the game ball in the game ball, because the fabric pocket layer can be sewn totally by sewing machine, the productivity is high. Because of the fabric pocket layer being outside the bladder, the manufactured ball is soft and of good tactility. At the same time because all of the sewing margins which can reshape the ball are left in the inner side, no slight unevenness is left on the surface of the fabric pocket, and the ball appears to be a complete sphere, obtaining good ball-controlling as well as keeping the spherecity.

Other objects, advantages and novel features of the present invention will become apparent from the following detailed description of the invention when considered in conjunction with the accompanying drawings.

DETAILED DESCRIPTION OF THE DRAWINGS

Figure 1:
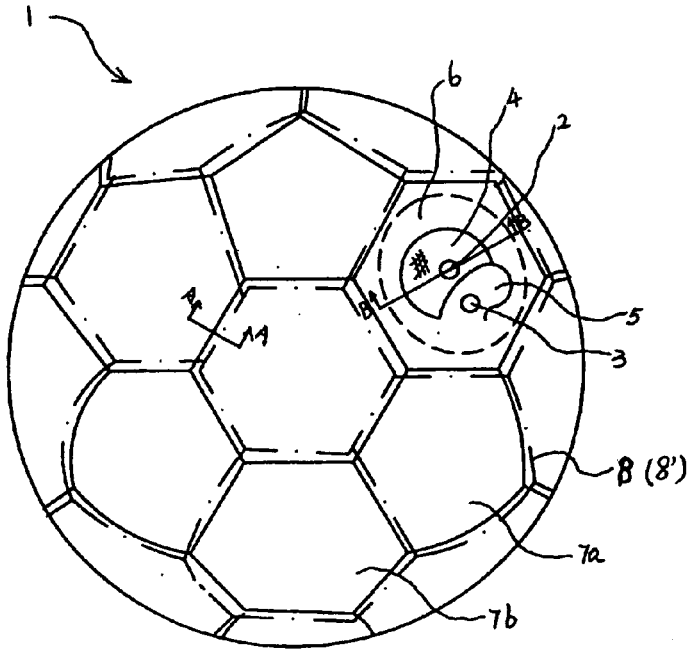
FIG. 1 is a front view showing a completed carcass of a game ball, constructed according to certain preferred embodiments of the present invention.
Figure 2:
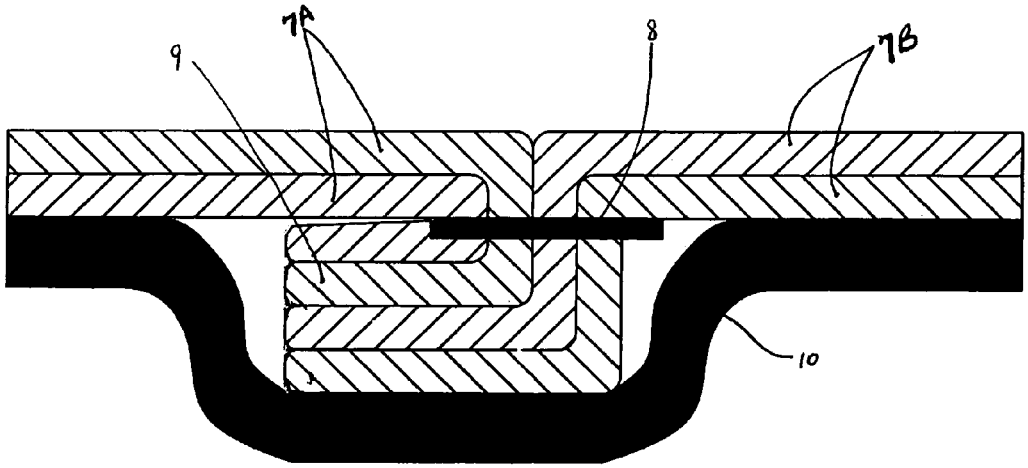
FIG. 2 is a schematic cross-sectional-view taken along line A-A of FIG. 1.

An embodiment for manufacturing a soccer ball is shown with reference to FIG. 1 and FIG. 2. It should be pointed out that the description only explains the structure of a soccer ball, however, said manufacturing method can certainly be applied to other balls for ball games having a construction where air is confined, such as volleyball, handball and Rugby soccer ball.

Figure 3:
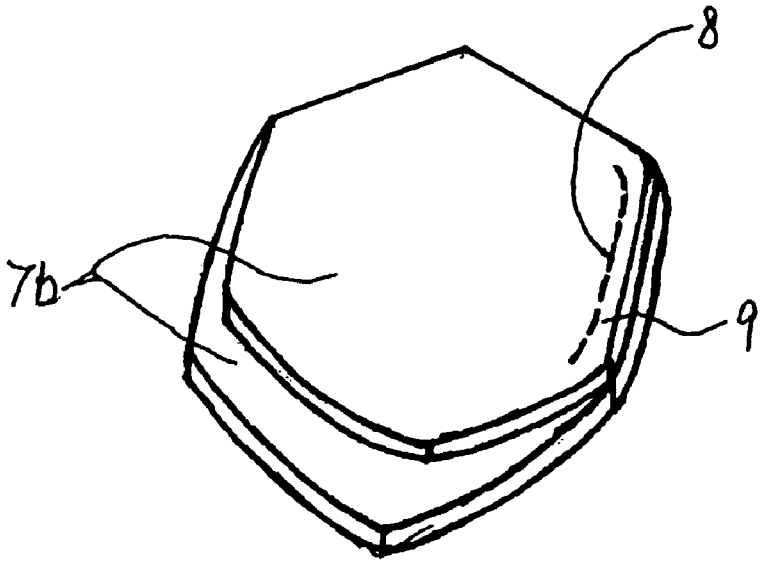
FIG. 3 is a schematic view of the sewn structure of two fabric pieces for the game ball of FIGS. 1 and 2.

Referring to FIGS. 1-3, FIG. 1 is a front view showing a completed carcass (fabric pocket layer with fitted bladder) of a game ball; FIG. 2 is a schematic cross-sectional-view taken on line A-A of FIG. 1; and FIG. 3 is a schematic view of the sewn structure of two fabric pieces of the ball of FIGS. 1 and 2.

Figure 7:
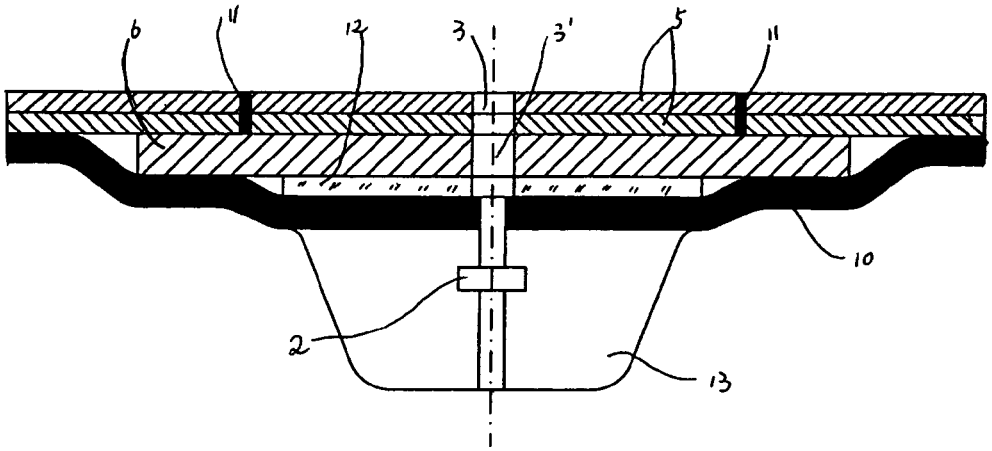
FIG. 7 is a schematic cross-sectional-view taken along line B-B of FIG. 1.

As shown in FIG. 1, 2, and 3, the fabric pocket layer 1 comprises a plurality of fabric pieces 7. At one of the fabric pieces 7, an opening 4 is formed, the shown opening 4 being used for reversing the fabric pocket layer and inserting the bladder 10. At the same time the opening-cover 5 cut from said fabric piece 7 is still connected with said fabric piece 7 in the base B, shown in dotted lines. Thus, the opening-cover 5 can open and close the opening 4. A valve opening 3 is located on the opening-cover 5. The valve opening 3 is used to insert a needle for air inflation through the valve 2 on the bladder 10 (with reference to FIG. 7). The dash-dot lines in FIG. 3 are the sewing lines sewn with sewing thread 8 between fabric pieces 7 and 9 denotes the sewn margin. As shown in FIG. 1, at the inner side of the opening 4, a reinforcing cloth 6 with a valve opening 3' is also attached. The reinforcing cloth 6 is adhered to the opening 4 in the inner side of the fabric pocket layer 1 as also shown in FIG. 7.

The bladder 10 is a hollow spherical shape composed of elastic materials, e.g. natural rubber, latex or butyl. As shown in FIG. 2, when bladder 10 is inserted in fabric pocket layer 1, sewn margin 9 is pressed towards the inner side of the fabric pocket layer 1. The fabric pieces 7 (7*a* and 7*b*) can be made of two pieces of fabric cloth as described in more detail below.

With reference to the drawings, the fabric pocket layer 1 in FIG. 1 is manufactured using the following processes.

Regular pentagonal fabric pieces 7*a* (12 pieces in the present shown embodiment) and regular hexagonal fabric pieces 7*b* (20 pieces in the present embodiment) are sewn together by a sewing machine to form a spherical fabric pocket layer 1. Said fabric pieces 7*a* and 7*b* are generally referred to as fabric pieces 7. The fabric pieces 7 can be made by the following ways. Pile two sheets of fabric cloth up with the condition that warp is orthogonal each other. Then adhere the two sheets of fabric cloth by latex to thereby reduce the extension force difference in any direction. At last the fabric cloth is cut into regular pentagonal fabric pieces 7*a* and regular hexagonal fabric pieces 7*b*. The sewing method of two adjacent fabric pieces 7 is illustrated in FIG. 3, the two fabric pieces are overlapped, sewn up the side with sewing thread 8 and leaving a sewn margin 9. For the present invention, all sides of all fabric pieces 7 are sewn together, when finished, the fabric pocket layer 1 forms a sphere with all of the sewn margins 9 located outside the sphere. The sewing can be performed using a sewing machine controlled by computer, otherwise, it can be performed using an ordinary sewing machine along sewing lines pre-printed on fabric pieces 7.

Figure 4:
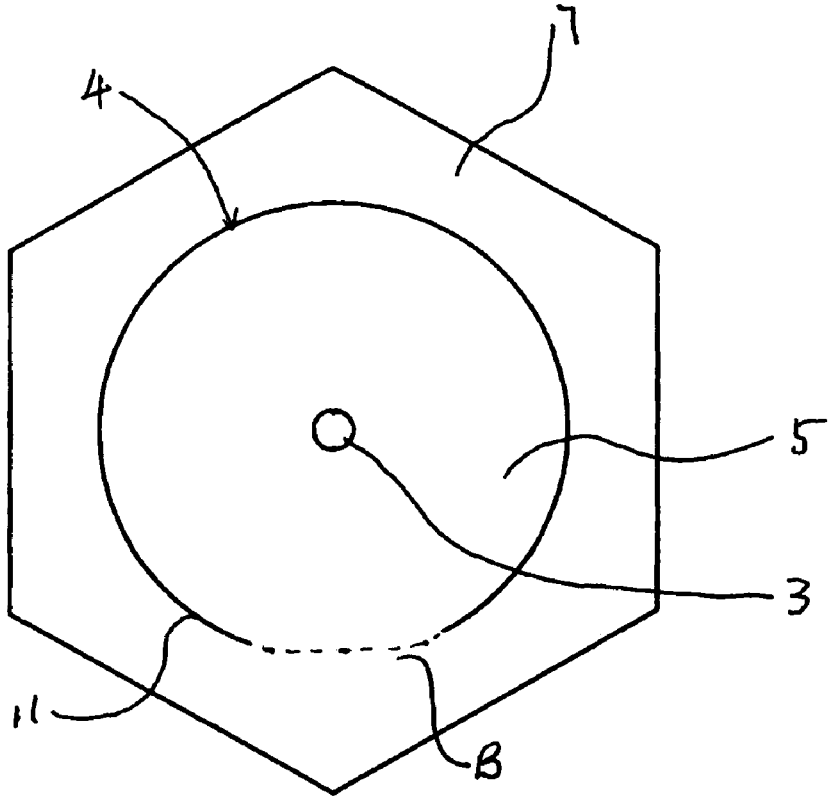
FIG. 4 is a schematic view of the fabric pieces at the opening of the ball of FIG. 1.

The opening 4 located on one of the fabric pieces 7 is formed as shown in FIG. 4. The cutting line 11 along the opening 4 cuts part of the fabric piece 7 form the opening 4 as well as form the opening-cover 5 which is connected to the fabric piece 7 on the base B and can be closed and opened. Ideally the diameter of the opening 4 will be 40-70 mm. A valve opening 3 is made in the opening-cover 5.

The fabric pocket layer 1 is reversed through the opening 4 so that sewn margins 9 which originally were on the outside are turned into the inner side. The bladder 10 is then inserted into the fabric pocket layer 1 through the opening 4, and subsequently the opening 4 is closed by adhering the opening-cover 5 on the reinforcing cloth 6.

Figure 6:
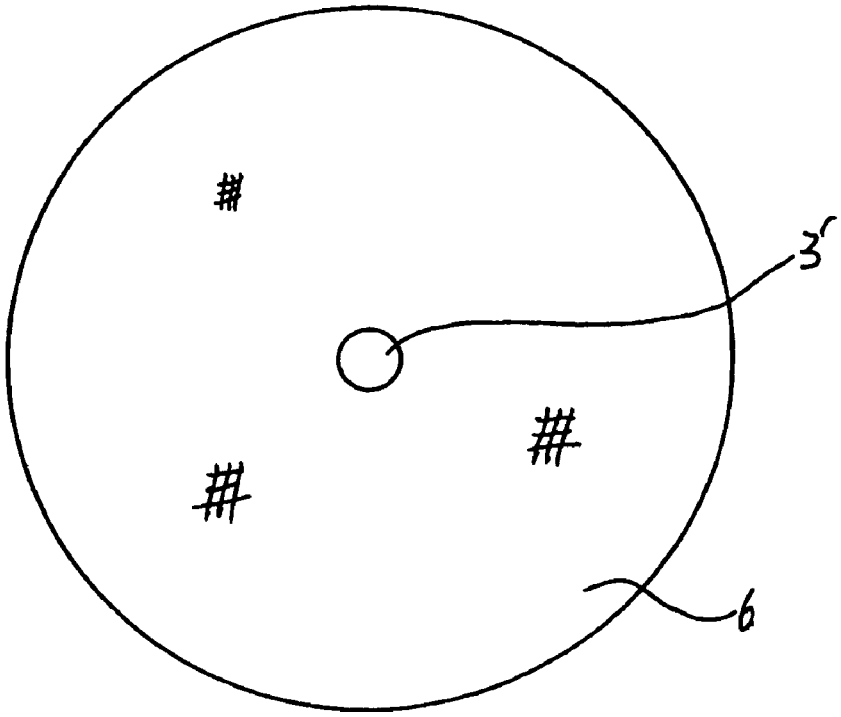
FIG. 6 is a schematic view of the reinforcing cloth for the opening of certain preferred embodiments of the present invention.

FIG. 6 is a schematic view of the reinforcing cloth 6. Said reinforcing cloth 6 is a round piece of a diameter of 60-100 mm with a valve opening 3' in the center.

FIG. 7 is a schematic cross-sectional-view of how the opening 4 is closed. As shown in the figure, generally speaking, the adhesion-assistant valve cloth 12 is sulfured and adhered onto the top of the valve house 13 of the bladder 10.

Before the bladder 10 is inserted into the fabric pocket layer 1, the reinforcing cloth 6 is adhered onto the valve cloth 12 in advance, and the valve opening 3' of the reinforcing cloth 6 is aligned with the valve 2 of the bladder 10. Here the fabric pieces 7 can be made of two pieces of the fabric cloth. Then the bladder 10 is inserted into the fabric pocket layer 1, the sewn margins 9 of which have already been turned into the inner side. The bladder 10 is inserted with the valve 2 and valve house 13 of the bladder 10 extending out the opening 4, and the following steps are performed:

Adhesive is placed onto the back side of the opening-cover 5 and the back side around the opening 4 of the fabric cloth 7;

Adhesive is placed onto the surface of the reinforcing cloth 6;

The reinforcing cloth 6 is adhered onto the back of the opening 4;

With the valve opening 3 of the opening-cover 5 aligned with the valve 2 of the bladder 10, the opening-cover 5 is adhered onto the reinforcing cloth 6 to close the opening 4 of the fabric pocket layer 1;

The composition of the bladder 10 and the fabric pocket layer 1 (i.e. carcass) is placed into a hollow ball mould at a temperature of 60~70° C., and after closing the mould, the bladder 10 is inflated with compressed air of a pressure of 9.0-10 kg/cm$^2$ and maintained for 3 to 5 minutes.

During the above process, the bladder 10 and the fabric pieces 7 as a composite unit are referred to as a ball carcass.

The sewing procedure of said fabric pocket layer 1 can be completely operated mechanically, therefore the productivity is high, and the quality of sewing is stable. At the same time, because the reinforcement layer of the bladder 10 of traditional winding-structure is replaced by the fabric pocket layer 1, it is easily manufactured and the performance to absorb impaction is quite good with longer durability.

Further, the opening-cover 5 is adhered firmly to the reinforcing cloth 6, and because there is no sewn margin 9 on the outside of the fabric pocket layer 1, there will be no slight unevenness at the opening 4. The ball will have a good appearance and tactility, and can easily be controlled by players during a game.

Here, the fabric pocket layer 1 is but a reinforcing layer. In the above mentioned embodiment, regular pentagonal and hexagonal fabric pieces 7 are sewn together to form a sphere, however, the pieces can have any shape as long as they can make a ball. For example, the sphere can be composed of 12 nearly trapezoid-shaped pieces, just like in the case of a volleyball; or the ball can be composed of 12 regular pentagonal pieces; or it can be composed 12 regular pentagonal and 20 triangle pieces; or it can be composed of two gourd-shaped pieces, just like in the case of a baseball.

Figure 5:
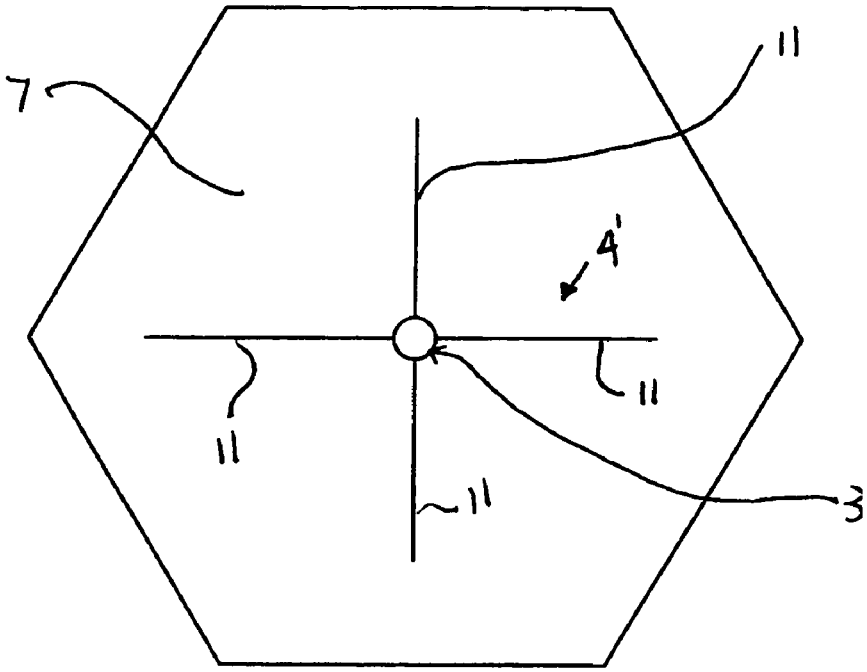
FIG. 5 is a schematic view of intersecting cutting lines of a cross-shaped opening, constructed according to certain preferred embodiments of the present invention.

Another embodiment of the opening 4' is shown in FIG. 5, said opening 4' is cut along the cross shaped cutting lines 11 of the opening, and a valve opening 3 is located at the cross point of the cutting lines 11. The shape of the cutting lines 11 is not limited to a cross and they can be Y shaped for example. The fabric pocket layer 1 with an opening 4' cut along the cutting line 11 can also be inserted into the bladder 10 through the opening 4' after the opening 4' is reversed.

In the above described embodiments, the opening-cover 5 is not completely separated from the fabric pieces 7, but it can also be cut into a stand-alone opening-cover, according to certain preferred embodiments of the invention.

Said adhesive can be a latex, neoprene, or polyurethane, according to certain preferred embodiments of the invention.

Further, in the above described embodiments, the valve opening 3 and the opening 4' are located at the same fabric piece 7. As a substitution according to certain preferred embodiments of the invention, the valve opening 3 and the opening 4' can be located at two different fabric pieces 7.

In the above described embodiments, methods with no reinforcing cloth 6 can also be employed to close the opening 4', according to certain preferred embodiments of the invention. A hand-stitched form can also be employed to sew the opening-cover 5 onto the opening 4' to close the opening 4', according to certain preferred embodiments of the invention. Although slight unevenness is formed around the opening 4' outside the fabric pocket 1, no obvious effect will be detected for the use of the ball.

The carcass manufactured by the above described methods can be used to make the needed ball for a ball game once the skin layer is attached to the carcass by placing leather panels 14 onto the fabric pocket layer 1.

Figure 8:
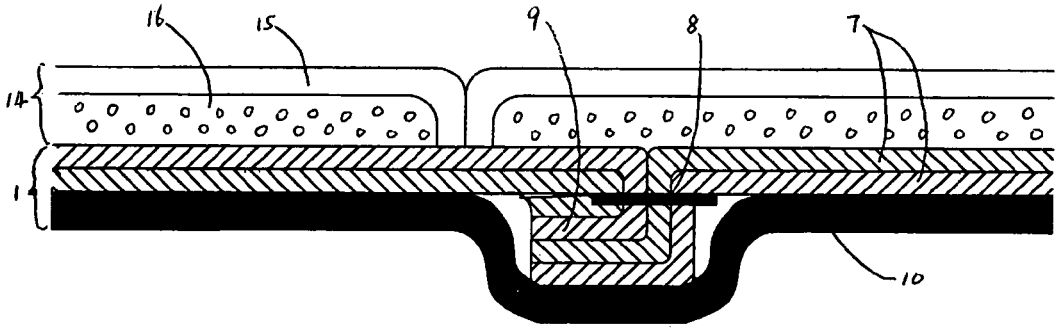
FIG. 8 is a schematic view showing the connection between the fabric pocket layer and leather panels according to preferred embodiments of present invention.

An embodiment of placing leather panels 14 onto the fabric pocket layer 1 is shown in FIG. 8. On the fabric pocket layer 1, leather panels 14 composed of foam 16 and artificial leather 15 (or genuine leather) are adhered. The adhesive is not shown in FIG. 8. However, the foam 16 can also be reduced, and the artificial leather can be adhered directly onto the fabric pocket layer 1, according to certain preferred embodiments of the invention. The ball shown in FIG. 8 is formed by skin pieces adhered onto the fabric pocket layer directly. Additionally, it can also adhere the skin pieces onto the covering rubber covered the fabric pocket layer as mentioned in the background art, according to certain preferred embodiments of the invention.

Figure 9:
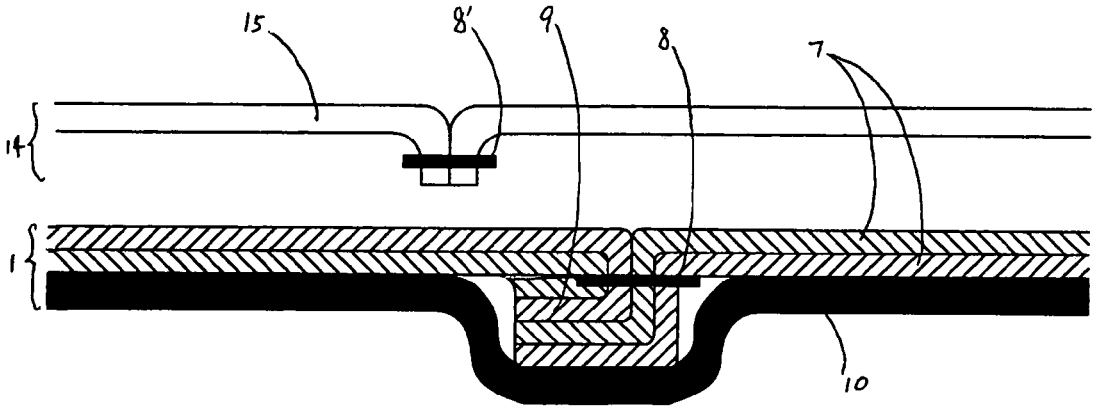
FIG. 9 is a schematic exploded view of the fabric pocket layer covered with sewn leather panels, according to preferred embodiments of the present invention.

Another embodiment shown in FIG. 9 is to place leather panels 15 sewn to be a sphere 14 by a sewing machine onto the fabric pocket layer 1. The leather panels 15 marginal edges are folded inward and sewn together with sewing thread 8'. This time because the fabric pocket layer 1 has the function of the reinforcing layer, liner material is not necessary for leather panels 15, and they can be sewn by a sewing machine. In this case, the carcass composed of the fabric pocket layer 1 and the bladder 10 are inserted into the leather panels 15 sewn into a sphere 14, the method for inserting and the closing method of the opening are the same as the closing method of the skin layer of the hand-stitched ball of said background techniques, and therefore will not be described here. Having this construction, because no adhesive is used, and an air layer lies between leather panels sphere 14 and the fabric pocket layer 1, softer tactility is obtained.

Figure 10:
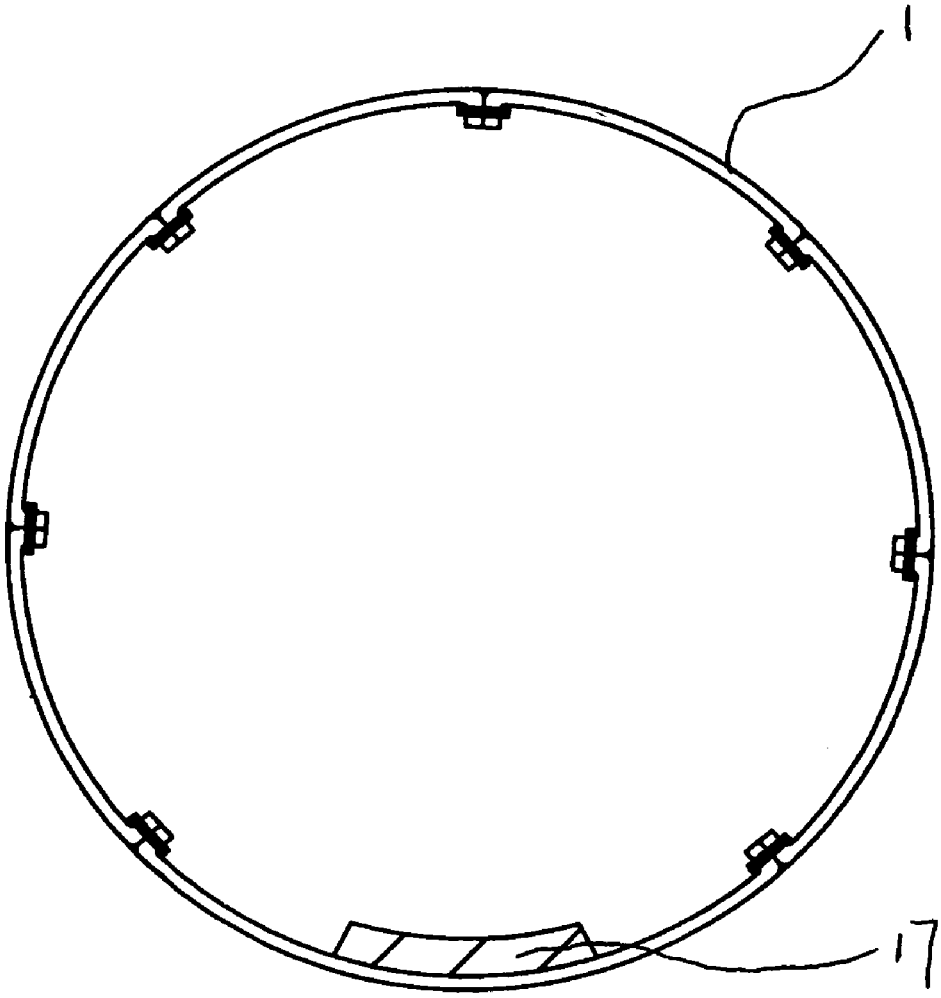
FIG. 10 is a schematic view of a fabric pocket layer with a counter weight according to certain preferred embodiments of the present invention.
Figure 11:
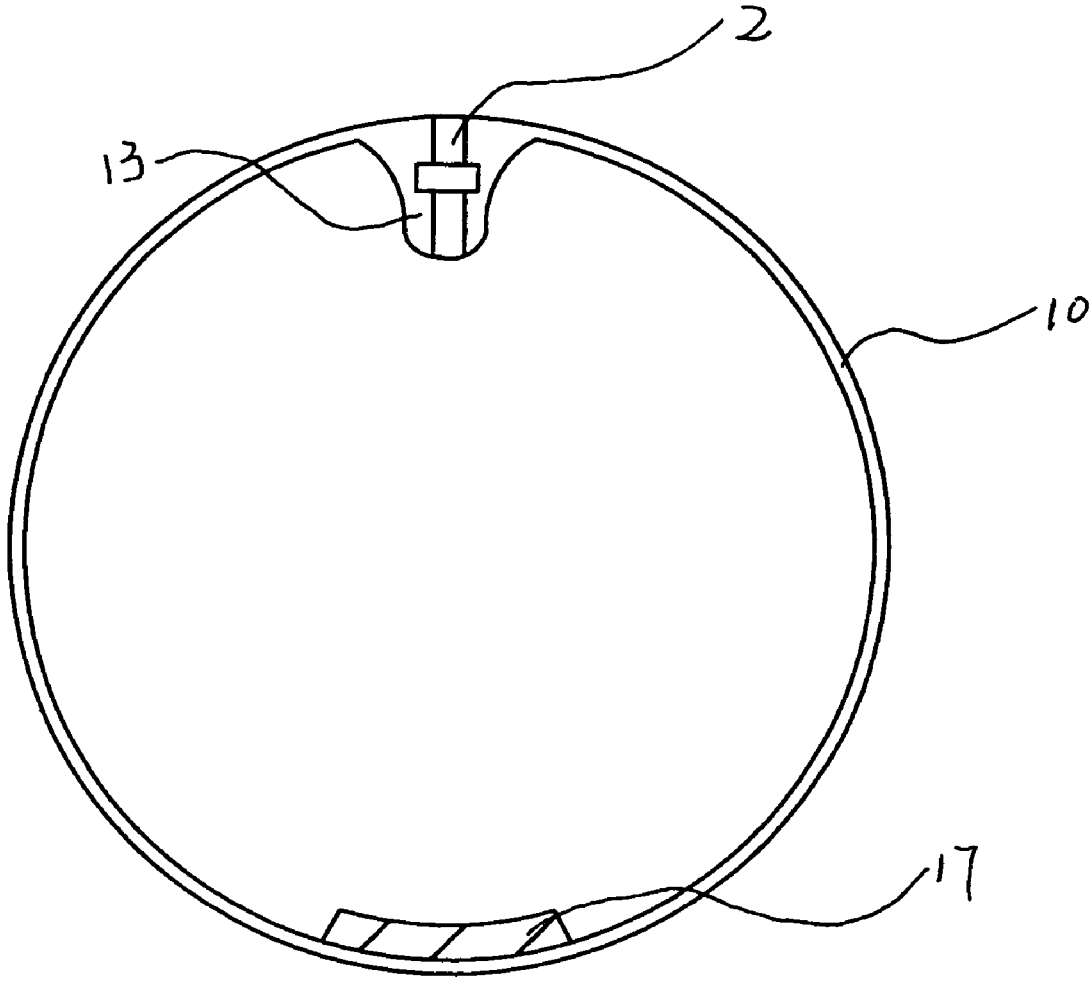
FIG. 11 is a schematic view of the bladder with a counter weight according to certain preferred embodiments of the present invention.

Further, as shown in FIG. 10 and FIG. 11, for better balancing performance of the ball, a counter weight 17 with similar mass as the valve 2 and valve house 13 is placed opposite to the valve 2 in the bladder 10 or on the fabric pocket layer 1, according to certain preferred embodiments of the invention. Said counter weight 17 can be made of rubber or fabric pieces.

It can be known from above that if the certain preferred embodiments of the present invention is applied, the opening is positioned almost identical with the position of the valve, and the opening is closed with adhesive, then the following features are present during the manufacturing of the ball for ball game.

(1) A plurality of fabric pieces are employed.

(2) Sewn margins that prevent the ball from spherical shape are all located on the inner side, hence a very smooth spherical surface without slight unevenness can be produced.

(3) All the procedures can be operated mechanically.

Therefore the manufactured ball according to certain preferred embodiments, presents one or more of the following advantages:

(1) The ball is soft, with good tactility and the performance of ball-controlling is good.

(2) There is no swaying during flying of the ball, with correct rolling and bouncing, and good performance of finger controlling.

(3) High productivity.

(4) Stable qualities (weight, size, sphericity)

(5) Good durability, because the sewing lines are not easy to split such as in a hand stitched ball.

Although embodiments of the present invention have been described in detail, for experienced members in this technical field, it will be obvious to make replacements, modifications and changes according to the above description. Therefore such replacements, modifications and changes should be included within the present invention if they fall into the spirit and range of the attached claims.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A carcass of a ball for a ball game, comprising:

a bladder with a valve for introducing air into said bladder;

a fabric pocket layer located outside said bladder composed of:

a plurality of fabric pieces sewn to form a spherical shape, with a hole for the valve, wherein the sewing thread for sewing said fabric pieces and the sewn margin are located at an inner side of said fabric pocket;

an opening located on one of the fabric pieces for reversing the fabric layer and placing the bladder in an inside of the reversed fabric layer;

a reinforcing member having a surface area greater than an area of said opening and less than a surface area of said one of the fabric pieces, said reinforcing member having a hole for the valve and is adhered to an inside surface of said fabric layer about a periphery of said opening; and an opening-cover formed in said one of said fabric pieces and adhered to said reinforcing member for closing said opening, wherein said hole for the valve is located in same position as said hole for the valve of said reinforcing member.

2. A carcass according to claim 1, wherein said hole for the valve is located at the position of the opening-cover.

3. A carcass according to claim 2, wherein the opening is a cut opening which is ring-shaped, and said valve opening of said fabric pocket layer is located in said opening-cover.

4. A carcass according to claim 3, wherein a cutting line forming said opening is an unclosed ring so that the opening-cover has a base connecting to the fabric piece.

5. A carcass according to claim 2, wherein the opening is formed by cutting lines, the cutting lines forming said opening having multiple cross cutting lines hence forming several pieces of opening-cover connected to the fabric piece on the base, and said valve opening of said fabric pocket layer being located at the cross point of said cutting lines.

6. A carcass according to claim 1, wherein sewing lines are pre printed on the fabric pieces.

7. A carcass according to claim 1, wherein a counter weight of similar weight as the weight of the valve and valve house is placed oppositely to the valve in the fabric pocket layer of the bladder.

8. A ball for a ball game, from inner to outer side in sequence comprising:

a bladder with a valve for introducing air into said bladder, a fabric pocket layer located outside said bladder, and a skin layer comprising a plurality of panels;

wherein said fabric layer includes, a plurality of fabric pieces sewn to form a spherical shape, with a hole for the valve, wherein the sewing thread for sewing said fabric pieces and the sewn margin are located at an inner side of said fabric pocket;

an opening located on one of the fabric pieces for reversing the fabric layer and placing the bladder in an inside of the reversed fabric layer;

a reinforcing member having a surface area greater than an area of said opening and less than a surface area of said one of the fabric pieces, said reinforcing member having a hole for the valve and is adhered to an inside surface of said fabric pocket layer about a periphery of said opening; and an opening-cover formed in said one of said fabric pieces and adhered to said reinforcing member for closing said opening, wherein said hole for the valve is located in same position as said hole for the valve of said reinforcing member.

9. A ball according to claim 8, wherein said skin layer is a skin layer of an adhesion structure formed by a plurality of skin pieces adhered onto the fabric pocket layer.

10. A ball according to claim 8, wherein said skin layer is a skin layer of a sewn structure sewn by a sewing machine.

11. An inflatable game ball comprising:

an inflatable bladder with a valve for introducing air into the bladder, a reinforcing layer surrounding the bladder, and a skin surrounding the reinforcing layer, wherein the reinforcing layer comprises:

a plurality of pieces sewn together along seams to form a spherical shape, an opening located on one of the pieces for reversing the reinforcing layer;

a reinforcing patch having a hole for a valve, a surface area of said reinforcing patch being greater than an area of said opening and less than a surface area of said one of the fabric pieces, such that said reinforcing patch is adhered to an inside surface of the reinforcing layer about a periphery of said opening, and an opening-cover formed in said one of said fabric pieces and adhered to said reinforcing patch for closing said opening, said opening-cover includes a valve hole;

wherein said opening is spaced from the seams for accommodating reversing of the spherical shape so that all the seams face inwardly, said opening also accommodating insertion of the inflatable bladder, and wherein said valve hole of said opening-cover is located in same position as said hole for the valve of said reinforcing member.

12. A ball according to claim 11, wherein the opening is formed by cutting said one of said pieces to form said opening-cover from said one of said pieces, and wherein said at least one opening-cover is adhered at the opening to said reinforcing patch after insertion of said bladder.

13. A ball according to claim 11, wherein said pieces are fabric pieces which are machine sewn together along said seams.

14. according to claim 11, wherein the skin comprises leather or imitation leather.

15. A ball according to claim 14, wherein the skin is adhesively connected to the reinforcing layer.

16. A ball according to claim 15, wherein the skin includes a plurality of skin pieces connected together.

17. A ball according to claim 14, wherein the skin includes a plurality of skin pieces sew together.

18. A carcass according to claim 1, further comprising a valve cloth positioned on the bladder about the valve and said reinforcing member is adhered to said cloth.

19. A ball according to claim 8, further comprising a valve cloth positioned on the bladder about the valve and said reinforcing member is adhered to said cloth.

20. A ball according to claim 11, further comprising a valve cloth positioned on the bladder about the valve and said reinforcing patch is adhered to said cloth.

* * * * *